US010435823B1

(12) United States Patent
Guo et al.

(10) Patent No.: US 10,435,823 B1
(45) Date of Patent: Oct. 8, 2019

(54) TOWEL FABRIC AND METHOD OF MANUFACTURE

(71) Applicant: Cove & Edgewater, LLC, Gardena, CA (US)

(72) Inventors: Yuehua Allen Guo, Palos Verdes Estates, CA (US); Jack Burns, Palos Verdes Estates, CA (US)

(73) Assignee: Cove & Edgewater, LLC, Gardena, CA (US)

( * ) Notice: Subject to any disclaimer, the term of this patent is extended or adjusted under 35 U.S.C. 154(b) by 134 days.

(21) Appl. No.: 15/830,527

(22) Filed: Dec. 4, 2017

Related U.S. Application Data

(60) Provisional application No. 62/429,236, filed on Dec. 2, 2016.

(51) Int. Cl.

| | |
|---|---|
| ***D02G 3/02*** | (2006.01) |
| ***D03D 1/00*** | (2006.01) |
| ***D03D 15/00*** | (2006.01) |
| ***D02G 3/44*** | (2006.01) |
| ***A47G 27/02*** | (2006.01) |
| ***A47K 10/02*** | (2006.01) |

(52) U.S. Cl.
CPC ..... *D03D 1/0017* (2013.01); *A47G 27/02* (2013.01); *A47K 10/02* (2013.01); *D02G 3/02* (2013.01); *D02G 3/44* (2013.01); *D03D 15/0044* (2013.01); *D03D 15/0094* (2013.01); *D03D 2700/0137* (2013.01); *D03D 2700/0144* (2013.01); *D03D 2700/0177* (2013.01); *D10B 2201/02* (2013.01); *D10B 2321/021* (2013.01); *D10B 2401/14* (2013.01); *D10B 2403/0114* (2013.01); *D10B 2503/00* (2013.01)

(58) Field of Classification Search
CPC .... D06C 27/00; D06C 29/00; D06C 2700/31; D10B 2201/02; B41J 3/4078; B41F 17/38
See application file for complete search history.

(56) References Cited

U.S. PATENT DOCUMENTS

| | | | | |
|---|---|---|---|---|
| 9,181,646 | B2 | 11/2015 | Feng | |
| 2007/0044286 | A1* | 3/2007 | Nohara | D04B 1/02 26/2 R |
| 2015/0182034 | A1* | 7/2015 | Liran | A47C 27/086 5/655.4 |

* cited by examiner

*Primary Examiner* — Eisa B Elhilo
(74) *Attorney, Agent, or Firm* — Eric Karich; Karich & Associates

(57) ABSTRACT

A fabric has first material yarns and second material yarns woven together to form a ground, The first material yarns are synthetic yarns, and the second material yarns are cotton pile yarns. A coloring process is performed which colors the second material yarns, but which does not take to the first material yarns. A second coloring or printing process is performed on the technical front.

19 Claims, 2 Drawing Sheets

TOWEL FABRIC AND METHOD OF MANUFACTURE

CROSS-REFERENCE TO RELATED APPLICATIONS

This application for a utility patent claims the benefit of U.S. Provisional Application No. 62/429,236, filed Dec. 2, 2016.

BACKGROUND OF THE INVENTION

Field of the Invention

This invention relates generally to fabrics, and more particularly to a warp knitted towel fabric and a method of manufacturing, dying, and printing said fabric.

Description of Related Art

The prior art teaches a wide range of fabrics, and in particular towels and similar fabric constructions, that are used for a broad range of purposes. Hand towels, beach towels, and similar towels are often constructed of cotton due to their superior absorbency and wicking properties. Many other forms of towels (e.g., golf towels, rally towels, etc.) are also known in the art. Many towels and related products include a blend of polyesters and related materials for providing other desirable qualities.

One drawback of using a blend of cotton and polyester is that each material has different properties in response to various dyes, and printing processes, as well as a variety of post-production processing and treatments.

It is desirable to provide a towel having a unique construction that includes a front side that is constructed of polyester, and a rear side that is cotton, so that when the rear side is dyed, the front side remains white, provides a superior surface for printing.

SUMMARY OF THE INVENTION

The present invention teaches certain benefits in construction and use which give rise to the objectives described below.

The present invention provides a fabric comprising: first material yarns and second material yarns woven together to form a ground that includes a combination of the first and second material yarns; the first material yarns being synthetic yarns having a linear mass density of 50 D-300 D, and a filament count of 36 F-576 F; and the second material yarns being cotton pile yarns having a thickness of 6 Ss-40 s.

In another embodiment, the invention is a method for manufacturing a fabric, the method comprising the steps of: weaving first material yarns and second material yarns to form a ground that includes a combination of the first and second material yarns, the first material yarns being synthetic yarns which form a technical front, and the second material yarns being cotton pile yarns which form a technical back; performing a coloring process on the first and second material yarns which colors the second material yarns, but which does not take to the first material yarns; performing a second coloring or printing process on the technical front without damaging the coloring already provided to the technical back.

A primary objective of the present invention is to provide a fabric, and method of manufacturing a fabric, having advantages not taught by the prior art.

Another objective is to provide a fabric, and method of manufacturing a fabric, that may be colored in a manner that only takes to one side of the fabric, so that the undyed (typically white) technical front of the fabric may be printed in a second process with a decorative design, company logo, etc.

A further objective is to provide a fabric, and method of manufacturing a fabric, wherein the coloring imparted to the technical back of the fabric does not show through to the technical front.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a fabric that provides superior qualities for dying and printing after production. The fabric may be used to manufacture towels (e.g., beach towels, hand towels, etc.), as well as other products that are formed of fabric and which may be improved with the printing methods described in greater detail below.

Figure 1:
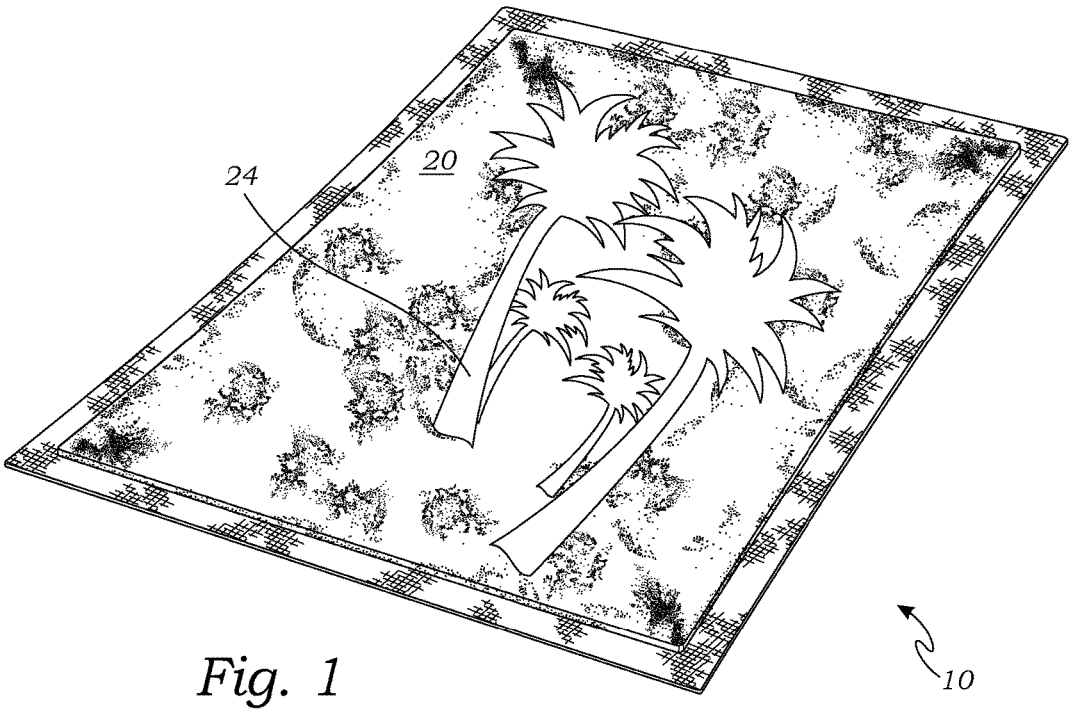
FIG. 1 is a top perspective view of a towel according to one embodiment of the present invention.
Figure 2:
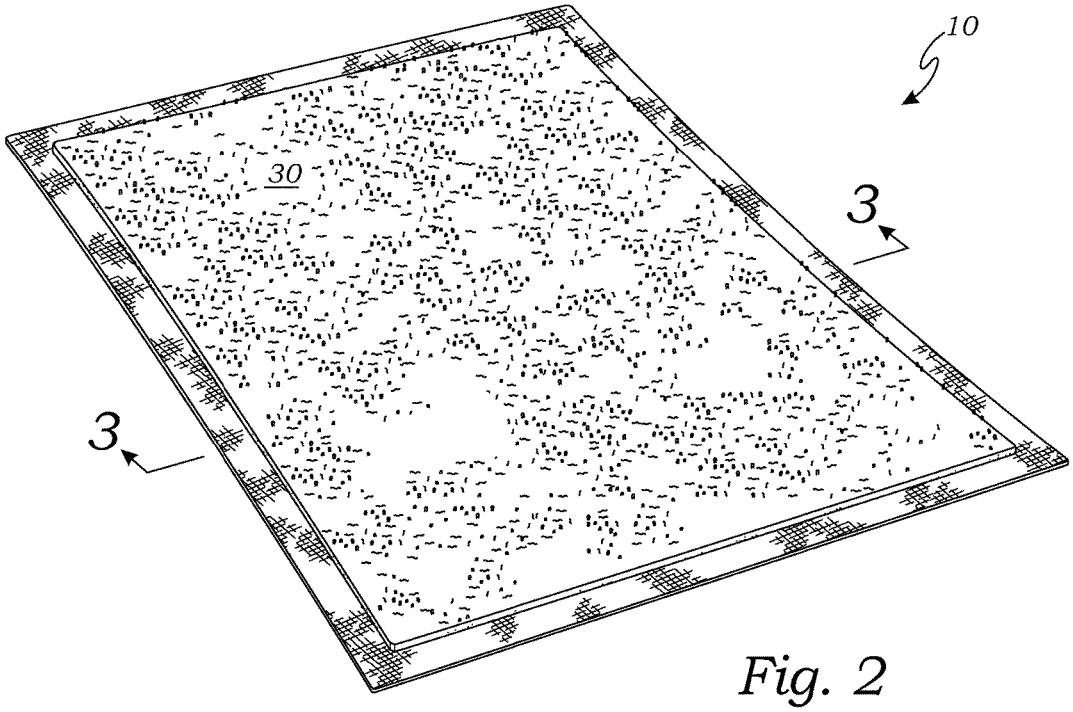
FIG. 2 is a bottom perspective view thereof.
Figure 3:
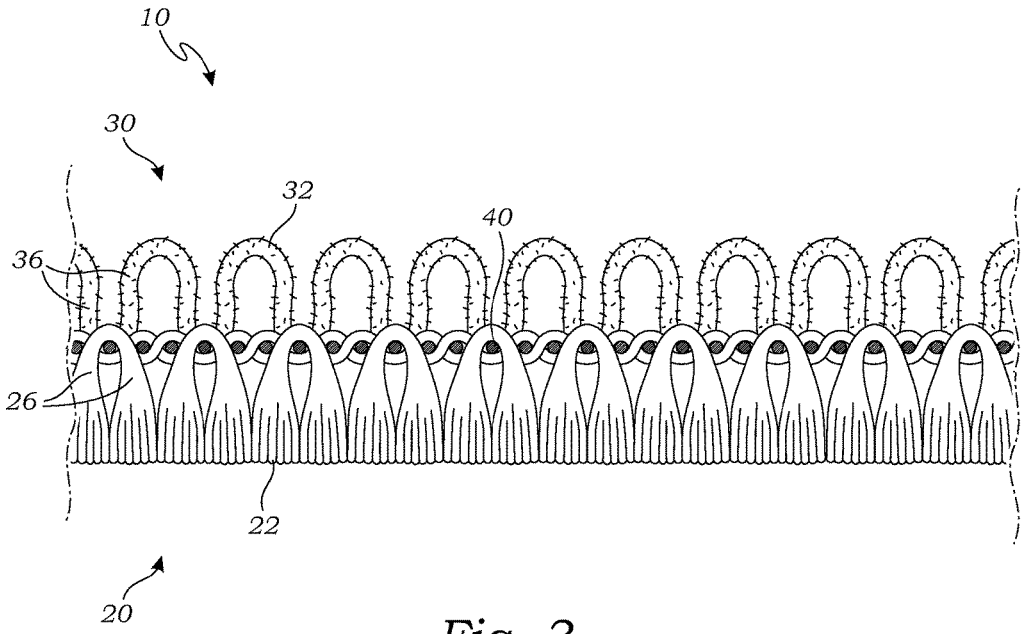
FIG. 3 is a sectional view thereof taken along line 3-3 in FIG. 2.

FIG. 1 is a top perspective view of a towel according to one embodiment of the present invention. FIG. 2 is a bottom perspective view thereof. FIG. 3 is a sectional view thereof taken along line 3-3 in FIG. 2.

As shown in FIGS. 1-3, in a first embodiment the fabric 10 may be warp knitted and comprise first material yarns 26 forming on a technical front 20, and second material yarns 36 forming a technical back 30. The second material yarns 36 are selected to receive a coloring process which does not take to the first material yarns 26. The coloring process may be any form of dye (e.g., reactive, disperse, etc.), printing (e.g., disperse dye printing, heat transfer printing, etc.), bleach white, etc., that is known in the art, which takes to the second material yarns 36, but not the first material yarns 26. This enables a unique manufacturing process wherein the technical back 30 receives a certain color, but the technical front 20 remains white, so that the technical front 20 can receive a second coloring or printing process. The coloring and/or printing process applied to the technical front 20 may include form of coloring, printing, or any combination thereof, so long as the desired decoration is achieved, without damaging the coloring already provided to the technical back 30.

The yarns used in the first material yarns 26 and the second material yarns 36 may be any suitable materials or blends that enable the coloring and/or printing processes described herein.

In the embodiment of FIGS. 1-3, the fabric 10 may be warp knitted such that the first material yarns 26 are synthetic pile yarns, and the second material yarns 36 are cotton pile yarns.

In this embodiment, as best shown in FIGS. 1 and 3, the synthetic pile yarns that form the first material yarns 26 form broken ends 22 (shown in FIG. 3) to produce a plush, velour surface. In another embodiment, the first material yarns 26 may be in the form of raised terry loops, tufts, or other similar structures known to those skilled in the art. When the second material yarns 36 are dyed, as discussed below, the second material yarns 36 remain white and are adapted to receive a second printing or dying process, as described in greater detail below.

The first material yarns 26 of this embodiment may have a linear mass density of 50 D-300 D, and a filament count of 36 F-576 F. In one embodiment, the linear mass density is about 150 D, and the filament count is about 288 F. These densities and filament counts have been found, through extensive experimentation, to provide superior printing characteristics, while resisting the first dying process. While one embodiment of the first material yarns 26 is described as preferred, alternative materials may also be used to form the first material yarns 26, and suitable alternative materials which meet the requirements described herein should be considered within the scope of the present invention.

In this embodiment, as best shown in FIG. 2, the cotton pile yarns of the second material yarns 36 may be in the form of raised terry loops 32, as shown in FIG. 3, or alternatively in the form of tufts, or other similar structures known to those skilled in the art. The cotton pile yarns may have a thickness of 6 Ss-40 s, in one embodiment a thickness of about 16 s. As discussed above, these densities and filament counts have been found, through extensive experimentation, to receive the first dying process, without showing the dye through to the other side. While one embodiment of the second material yarns 36 is described as preferred, alternative materials may also be used to form the second material yarns 36, and suitable alternative materials which meet the requirements described herein should be considered within the scope of the present invention.

In one embodiment, the second material yarns 36 may be 100% cotton, and not include any significant amount of synthetic material, aside from insignificant contaminants. Insignificant, for purposes of this application, is defined to mean that the amount that is small enough, as deemed by one skilled in the art, to not impair the dying steps described herein. The technical front 20 of this embodiment is formed of a synthetic material, in this embodiment polyester.

In an alternative embodiment, alternative materials may be used or included, including linen, silk, wool, cashmere, hemp, jute, bamboo, rayon, modal, bamboo, polyolefins, nylon, acrylics, and rayon, or any combination thereof which provides suitable dying characteristics as described above.

As shown in FIG. 3, the yarns of the technical front 20 and the technical back 30 may be woven together to form a ground 40 that includes a combination of the synthetic and cotton yarns, in this case about 52% cotton and about 48% synthetic yarns.

Once the fabric 10 has been woven (e.g., warp knit, or other suitable method), the cotton pile yarns 36 of the technical back 30 are then colored with a dye that takes to cotton, in this case a reactive dye. In alternative embodiments, alternative dyes and coloring processes may be utilized, as long as the dye only takes to the cotton and not the synthetic yarn. This process results in the technical back 30 taking the color of the dye, while leaving the synthetic yarn of the technical front 20 white.

The technical front 20 is then printed with an image 24, as shown in FIG. 1, such as any form of decoration, corporate logo, name or slogan, any form of printed material that may be desired by a purchaser or the towel. The image 24 is formed on the clean white surface of the technical front 20, which provides a superior contrast to a prior art towel, wherein the image would be printed on a colored surface, colored with the dye imparted to an entire fabric.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A fabric comprising:

first material yarns and second material yarns woven together to form a ground that includes a combination of the first and second material yarns;

the first material yarns being synthetic yarns having a linear mass density of 50 D-300 D, and a filament count of 36 F-576 F;

the second material yarns being cotton pile yarns having a thickness of 6 s-40 s.

2. The fabric of claim 1, wherein the second material yarns are 100% cotton.

3. The fabric of claim 1, wherein the first material yarns are polyester.

4. The fabric of claim 1, wherein the ground includes a combination of the synthetic and cotton yarns that is about 52% cotton and about 48% synthetic yarns.

5. The fabric of claim 1, wherein the fabric is colored with a reactive dye only takes to the cotton yarn of the technical back, but not to the synthetic yarn of the technical front, and then printed with an image on the technical front.

6. A method for manufacturing a fabric, the method comprising the steps of:

weaving first material yarns and second material yarns to form a ground that includes a combination of the first and second material yarns, the first material yarns being synthetic yarns which form a technical front, and the second material yarns being cotton pile yarns which form a technical back;

performing a coloring process on the first and second material yarns which colors the second material yarns, but which does not take to the first material yarns;

performing a second coloring or printing process on the technical front without damaging the coloring already provided to the technical back.

7. The method of claim 6, wherein the fabric is warp knitted.

8. The method of claim 6, wherein the first material yarns form broken ends to produce a plush, velour surface.

9. The method of claim 6, wherein the first material yarns have a linear mass density of 50 D-300 D, and a filament count of 36 F-576 F.

10. The method of claim 6, wherein the first material yarns have a linear mass density of about 150 D, and the filament count is about 288 F.

11. The method of claim 6, wherein the second material yarns are in the form of raised terry loops having a thickness of 6 s-40 s.

12. The method of claim 6, wherein the second material yarns are in the form of raised terry loops having a thickness of about 16 s.

13. A method for manufacturing a towel, the method comprising the steps of:

weaving cotton first material yarns and polyester second material yarns to form a ground that includes a combination of the first and second material yarns, the first material yarns forming a technical front, and the second material yarns forming a technical back;

coloring the towel with a reactive dye only takes to the cotton yarn of the technical back, but not to the synthetic yarn of the technical front; and printing an image on the technical front.

14. The method of claim 13, wherein the fabric is warp knitted.

15. The method of claim 13, wherein the first material yarns form broken ends to produce a plush, velour surface.

16. The method of claim 13, wherein the first material yarns have a linear mass density of 50 D-300 D, and a filament count of 36 F-576 F.

17. The method of claim 13, wherein the first material yarns have a linear mass density of about 150 D, and the filament count is about 288 F.

18. The method of claim 13, wherein the second material yarns are in the form of raised terry loops having a thickness of 6 s-40 s.

19. The method of claim 13, wherein the second material yarns are in the form of raised terry loops having a thickness of about 16 s.

* * * * *